US005378566A

United States Patent [19]

Yu

[11] Patent Number: 5,378,566

[45] Date of Patent: Jan. 3, 1995

[54] STRUCTURALLY SIMPLIFIED ELECTROPHOTOGRAPHIC IMAGING MEMBER

[75] Inventor: Robert C. U. Yu, Webster, N.Y.

[73] Assignee: Xerox Corporation, Stamford, Conn.

[21] Appl. No.: 970,459

[22] Filed: Nov. 2, 1992

[51] Int. Cl.[6] ..... G03G 5/14

[52] U.S. Cl. ..... 430/58; 430/59; 430/64; 430/908

[58] Field of Search ..... 430/58, 59, 64, 908

[56] References Cited

U.S. PATENT DOCUMENTS

| | | | |
|---|---|---|---|
| 4,464,450 | 8/1984 | Teuscher | 430/59 |
| 4,654,284 | 3/1987 | Yu et al. | 430/59 |
| 4,664,995 | 5/1987 | Morgan et al. | 430/64 |
| 4,786,570 | 11/1988 | Yu et al. | 430/58 |
| 4,869,988 | 9/1989 | Ong et al. | 430/59 |
| 4,946,754 | 8/1990 | Ong et al. | 430/59 |
| 5,008,169 | 4/1991 | Yu et al. | 430/59 |

*Primary Examiner*—John Kight, III
*Assistant Examiner*—John M. Cooney, Jr.

[57] ABSTRACT

An electrophotographic imaging member including a substrate, a hole blocking adhesive layer, a charge generating layer and a charge transport layer, the hole blocking adhesive layer including a polyester film forming binder having dispersed therein a particulate reaction product of metal oxide particles and a hydrolyzed reactant selected from the group consisting of a nitrogen containing organo silane, an organotitanate and an organozirconate and mixtures thereof. Preferably, the electrophotographic imaging member is free of any distinct adhesive layer in contiguous contact with the hole. blocking adhesive layer. This imaging member may be utilized in an electrophotographic imaging process.

16 Claims, 2 Drawing Sheets

STRUCTURALLY SIMPLIFIED ELECTROPHOTOGRAPHIC IMAGING MEMBER

BACKGROUND OF THE INVENTION

This invention relates in general to electrostatography and, more specifically, to a structurally simplified electrophotographic imaging member and processes for preparing and using the imaging member.

A photoconductive layer for use in electrophotography or xerography may be a homogeneous layer of a single material such as vitreous selenium or it may be a composite layer containing a photoconductor and another material. One type of composite photoconductive layer used in xerography is illustrated in U.S. Pat. No. 4,265,990 which describes a photosensitive member having at least two electrically operative layers. One layer comprises a photoconductive layer which is capable of photogenerating holes and injecting the photogenerated holes into a contiguous charge transport layer. Generally, where the two electrically operative layers are supported on a conductive layer with the photoconductive layer capable of photogenerating holes and injecting photogenerated holes sandwiched between the contiguous charge transport layer and the supporting conductive layer, the outer surface of the charge transport layer is normally charged with a uniform charge of a negative polarity and the supporting electrode is utilized as an anode. Obviously, the supporting electrode may also function as an anode when the charge transport layer is sandwiched between the supporting electrode and a photoconductive layer which is capable of photogenerating electrons and injecting the photogenerated electrons into the charge transport layer. The charge transport layer in this embodiment, of course, must be capable of supporting the injection of photogenerated electrons from the photoconductive layer and transporting the electrons through the charge transport layer.

Various combinations of materials for charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more of certain diamine compound. Various generating layers comprising photoconductive layers exhibiting the capability of photogeneration of holes and injection of the holes into a charge transport layer have also been investigated. Typical inorganic photoconductive materials utilized in the generating layer include amorphous selenium, trigonal selenium, and selenium alloys such as selenium-tellurium, selenium-tellurium-arsenic, selenium-arsenic, and mixtures thereof. Typical organic photoconductive materials include benzimidazole perylenes, phthalocyanines, azo pigments, and the like. The charge generation layer may comprise a homogeneous photoconductive material or particulate photoconductive material dispersed in a binder. Other examples of homogeneous and binder charge generation layer are disclosed in U.S. Pat. No. 4,265,990. Additional examples of binder materials such as poly(hydroxyether) resins are taught in U.S. Pat. No. 4,439,507. The disclosures of U.S. Pat. No. 4,439,507 and U.S. Pat. No. 4,265,990 are incorporated herein in their entirety. Photosensitive members having at least two electrically operative layers as disclosed above provide excellent images when charged with a uniform negative electrostatic charge, exposed to a light image and thereafter developed with finely developed electroscopic marking particles. However, when the supporting conductive substrate comprises a metal having an outer oxide surface such as aluminum oxide, difficulties have been encountered with these photosensitive members under extended electrostatographic cycling conditions found in high volume, high speed copiers, duplicators and printers. For example, it has been found that when certain charge generation layers comprising a resin and a particulate photoconductor are adjacent an aluminum oxide layer of an aluminum electrode, the phenomenon of "cycling-up" is encountered. Cycling-up is the build-up of residual potential through repeated electrophotographic cycling. Build-up of residual potential can gradually increase under extended cycling conditions to as high, for example, as 300 volts. Residual potential causes the surface voltage to increase accordingly. Build-up of residual potential and surface voltage causes ghosting, increased background on final copies and cannot be tolerated in precision high-speed, high-volume copiers, duplicators, and printers.

It has also been found that photosensitive members having a homogeneous generator layer such as As2Se3 such as those disclosed in U.S. Pat. No. 4,265,990, exhibit "cycling-down" of surface voltage when operated at extended cycling conditions found in high speed, high volume copiers, duplicators and printers. When cycling-down occurs the surface voltage and charge acceptance decrease as the dark decay increases in the areas exposed and the contrast potential for good images degrades and causes faded images. This is an undesirable fatigue-like problem and is unacceptable for high speed, high speed, high volume applications.

U.S. Pat. No. 4,464,450 discloses the fabrication of an electrophotographic imaging member having two electrically operative layers including a charge transport layer and a charge generating layer which overlie a siloxane film coated on a conductive metal/polymer film supporting substrate. The siloxane film is a cross-linked coating comprising a reaction product of a hydrolyzed silane having an amine functional group to eliminate hole injection from the underlying conductive metal/polymer film substrate and suppress cycle-down problems of a system utilizing negative charging electrophotographic imaging processes. Electrophotographic imaging members fabricated with this silane hole blocking layer described above to provide electrical cyclic stability have produced excellent electrophotographic imaging members. However, because the hydrolysis process for the silane and the intermolecular crosslinking reaction to form the siloxane coating are spontaneous, it can be difficult to consistently control the quality of the outcome. The formation of islands of siloxane aggregates and thickness nonuniformity may occur in some silane coating. The siloxane aggregates have been identified as a possible source associated with the white spot printout. Also silane coating thickness nonuniformity is seen to adversely affect copy quality. Moreover, the silane's inherent hydrophilic characteristics can weaken the adhesion bond strength at the silane/metal interface. Hence, silane layer delamination may occur when the imaging belt is cycled in a machine in a high humidity environment. Moreover, a separate adhesive layer is often needed to provide good adhesion linkage between the silane layer and the charge generating layer. When fabricated into an imaging belt by ultrasonic seam welding techniques, seam delamination/-cracking may occur as the belt flexes over small diameter (e.g., 19 ram) belt support rollers under humid conditions. Since the silane hole blocking layer is applied to the electrophotographic imaging member as a separate coating step, it can reduce imaging member fabrication throughput by up to 33 percent and increases material and manpower costs. Each extra coating step, such as the silane coating step, also reduces production yields by increasing the likelihood of damage due to scratches caused by handling and coating defects.

In the fabrication of seamless flexible electrophotographic imaging members employing a conductive polymeric support substrate, i.e. a substrate that does not utilize an inorganic conductive layer, silane coatings are not acceptable as a hole blocking layer because the substrate support has no metal oxides with which the silanol groups of the silane layer can react to form adhesive bonds.

For some inverted electrophotographic imaging member designs using a positive electrostatic charging process (e.g., where the charge transport layer is sandwiched between a conductive substrate and a charge generating layer) the silane layer on the exposed outer surface of the charge generation layer of the imaging member tends to wear rapidly and requires an overcoating iayer for protection.

The formation and development of electrostatic latent images on the imaging surfaces of photoconductive materials by electrostatic means is well known as disclosed, for example, in U.S. Pat. No. 4,265,990, U.S. Pat. No. 4,618,551, and U.S. Pat. No. 4,346,158. The disclosures of the aforementioned patents are incorporated herein by reference in their entirety.

INFORMATION DISCLOSURE STATEMENT

U.S. Pat. No. 4,654,284 discloses an imaging member comprising at least a flexible supporting substrate having an electrically conductive surface and an anti-curl layer, the anti-curl layer comprising a film forming binder, crystalline particles dispersed in the film forming binder and a reaction product of a bi-functional chemical coupling agent with both the film forming binder and the crystalline particles.

U.S. Pat. No. 4,786,570 discloses a flexible electrophotographic imaging member comprising a flexible substrate having an electrically conductive surface, a hole blocking layer comprising an aminosilane reaction product, an adhesive layer of various types of copolyester resins, a charge generation layer comprising a film forming binder resin, photogenerating pigment dispersion and a diamine charge transport compound, and a charge transport layer of a diamine charge transport compound dissolved in a film forming polycarbonate resin.

U.S. Pat. No. 4,869,988 and U.S. Pat. No. 4,946,754 describe layered photoconductive imaging members with transport layers incorporating biarylyl diarylamines, N,N-bis(biaryiyl)anilines, and tris(biarylyl)amines as charge transport compounds. The layered photoconductive imaging members comprise a supporting substrate, a photogenerating layer optionally dispersed in an inactive resinous binder, and in contact therewith a charge transport layer comprising the amine or aniline charge transport compounds, or mixtures thereof dispersed in resinous binders. These patent applications also disclose, for example, polyester adhesive and metal oxide or organo silane hole blocking layers.

U.S. Pat. No. 5,008,169, a simplified photoconductive imaging member design is disclosed. This photoconductive imaging member comprises a flexible support substrate, a conductive ground plane layer, a hole blocking-adhesive layer comprising of an organo polyphosphazene to minimize the electrophotographic imaging process cycling-down problem as well as providing adhesion linkage, a charge generating layer, and a charge transport layer.

While the above mentioned electrophotographic imaging members are suitable for each intended purpose, there continues to be a need for improved imaging members, particularly structurally simplified multi-layered electrophotographic imaging members.

SUMMARY OF THE INVENTION

It is therefore an object of the present invention to provide improved flexible layered electrophotographic imaging members which overcome the above noted disadvantages.

It is also an object of the present invention to provide a structurally simplified flexible layered electrophotographic imaging members having a modified hole blocking adhesive layer that possesses both hole blocking and adhesive characteristics.

It is yet another object of the present invention to provide improved flexible layered electrophotographic imaging members having a charge transport layer in contact with a charge generating layer for use with liquid or dry developers.

It is a further object of the present invention to provide improved flexible layered electrophotographic imaging members having a supporting substrate, a single layer performing both hole blocking and adhesive interface functions, a charge generating layer, and a charge transport layer.

It is yet another object of the present invention to provide improved flexible layered electrophotographic imaging members having a supporting substrate, a charge transport layer, a charge generating layer and a hole blocking adhesively adhering to the charge generating layer.

It is still yet another object of the present invention to provide improved positive charging electrophotographic imaging members having an improved wear resistant surface.

It is another object of the present invention to provide improved imaging and printing processes.

It is yet another object of the present invention to provide improved flexible electrophotographic imaging member layer adhesion resistant to delamination under high humidity conditions.

It is still another object of the present invention to provide a flexible electrophotographic imaging member having improved adhesion between at least the charge generating layer and hole blocking adhesion layer.

It is yet a further object of the present invention to provide a flexible electrophotographic imaging member which exhibits resistance to fatigue seam cracking delamination.

These and other objects of the present invention are accomplished by providing an electrophotographic imaging member comprising a substrate, a hole blocking adhesive layer, a charge generating layer and a charge transport layer, the hole blocking adhesive layer comprising a polyester film forming binder having dispersed therein a particulate reaction product of metal oxide particles and a hydrolyzed reactant selected from the group consisting of a nitrogen containing organo silane, an organotitanate and an organozirconate and mixtures thereof. Preferably, the electrophotographic imaging member is free of any distinct adhesive layer in contiguous contact with the hole blocking adhesive layer. This imaging member may be utilized in an electrophotographic imaging process.

The supporting substrate may be opaque or substantially transparent and may comprise numerous suitable materials having the required mechanical properties. The substrate may further be provided with an electrically conductive surface. Accordingly, the substrate may comprise a layer of an electrically non-conductive or conductive material such as an inorganic or organic composition. As electrically non-conducting materials, there may be employed various resins known for this purpose including polyesters, polycarbonates, polyamides, polyurethanes, and the like. The electrically insulating or conductive substrate should be flexible and may have any number of different configurations such as, for example, a sheet, a scroll, an endless flexible belt, and the like. Preferably, the substrate is in the form of an endless flexible belt and comprises a commercially available biaxially oriented polyester known as Mylar, available from E.I. du Pont de Nemours & Co., or Melinex, available from ICI Americas Inc.

The thickness of the substrate depends on numerous factors, including mechanical performance and economic considerations. The thickness of the substrate may range from about 65 micrometers to about 150 micrometers, and preferably from about 75 micrometers to about 125 micrometers for optimum flexibility and minimum induced surface bending stress when cycled around small diameter rollers, e.g., 19 millimeter diameter rollers. The substrate for a flexible belt may be of substantial thickness, for example, over 200 micrometers, or of minimum thickness, for example less than 50 micrometers, provided there are no adverse effects on the final photoconductive device.

As indicated above, the entire substrate may be made up of electrically conductive material or may comprise multiple layers in which an outer layer comprises an electrically conductive material. The electrically conductive material may comprise an electrically conductive metal layer which may be formed, for example, on an underlying layer by any suitable coating technique, such as a vacuum depositing technique. Typical metals include aluminum, zirconlure, niobium, tantalum, vanadium, hafnium, titanium, nickel, stainless steel, chromium, tungsten, molybdenum, and the like, and mixtures thereof. The conductive layer may vary in thickness over substantially wide ranges depending on the optical transparency and flexibility desired for the electrophotographic imaging member. Accordingly, for a flexible photoresponsive imaging device, the thickness of the conductive layer may be between about 20 Angstroms to about 750 Angstroms, and more preferably from about 50 Angstroms to about 200 Angstroms for an optimum combination of electrical conductivity, flexibility and light transmission.

Regardless of the technique employed to form the metal layer, a thin layer of metal oxide forms on The outer surface of most metals upon exposure to air. Thus, when other layers overlying the metal layer are characterized as "contiguous" layers, it is intended that these overlying contiguous layers may, in fact contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as, for example, copper iodide and conductive indium tin oxide, as a transparent layer for light having a wavelength between about 4000 Angstroms and about 9000 Angstroms or a conductive carbon black dispersed in a plastic binder as an opaque conductive layer.

The hole blocking adhesive layer of this invention may be applied to the conductive substrate if the charge generating layer is located between the substrate and the charge transport layer or applied to the charge generating layer if the charge transport layer is located between the substrate and the charge generating layer. The hole blocking adhesive layer comprises a polyester film forming binder having dispersed therein a particulate reaction product of metal oxide particles and a hydrolyzed reactant selected from the group consisting of a nitrogen containing organo silane, an organotitanate and an organozirconate and mixtures. The particulate reaction product of silica (silicon dioxide) particles and a hydrolyzed reactant preferably comprises synthetic amorphous fumed silicas (e.g., Aerosil, available from Degussa AG or Cab-O-Sil, available from Cabot, Inc.) that have been surface treated with an amino organosilane coupling agent prior to incorporation into the polyester binder matrix of the hole blocking adhesive layer of this invention. However, other finely divided metal oxide particles may be substituted for silica. Typical finely divided metal oxide particles include, for example, aluminum oxide, zirconlure oxide, titanium dioxide, and the like. Generally, satisfactory results may be achieved with an average metal oxide particle size of between about 50 Angstroms and about 300 angsttoms. These particles preferably have a generally spherical shape. However, they may have any other suitable shape such as granular, irregular and the like. The metal oxide particles usually have a density between about 1.8 and about 2.6 gms/cc. The maximum particle size selected is preferably less than the thickness of the dried hole blocking adhesive layer.

A loading of between about 10 and about 95 weight percent by weight particulate metal oxide reaction product based on the total weight of the hole blocking adhesive layer is satisfactory. A loading of between about 20 to about 90 weight percent by weight is preferred. Optimum ease of layer application is achieved with a loading of between about 50 and about 85 weight percent particulate metal oxide reaction product. With the hole blocking adhesive layer of this invention, the need for the separate adhesive layer usually employed in prior art electrophotographic imaging members is eliminated.

Organosilanes which having hole blocking properties are hydrolyzed and reacted with the synthetic amorphous fumed silicas or other suitable metal oxides. Typical organosilanes include, for example, 3-aminopropyl triethoxy silane, (N.N'-dimethyl 3-amino)propyl triethoxysilane, N,N-dimethylamino phenyl triethoxy silane, N-phenyl aminopropyl trimethoxy silane, trimethoxy silylpropyl-diethylene triamine, N-aminoethyl-3-aminopropyl-trimethoxysilane, N-(2-aminoethyl)-3-aminopropyl-trimethoxysilane, N-2-aminoethyl-3-aminopropyl-trimethoxysilane, N-2-aminoethyl-3-aminopropyltris(ethyl-ethoxy)silane, p-aminophenyl trimethoxysilane, 3aminopropyldiethylmethylsilane, 3-aminopropyl trimethoxysilane, N-methylaminopropyltriethoxysilane, methyl[2-(3trimethoxysilypropylamino)ethylamino]-3-proprionate, (N,N'-dimethyl 3amino)propyl triethoxysilane, and 3[2(vinyl benzylamino)ethylamino]propyltrimethoxy silane. Alternatively, organotitanates or organozirconates may be substituted for the organosilanes for silica particle surface treatment. Typical organotitanates include, for example, neoalkoxy, tri(dioctylphosphato titanate), neoalkoxy, tri(N-ethylaminoethylamino)titanate, neoalkoxy, tri(m-amino)phenyl titanate, isopropyl di(4-amino benzoyl)isostearoyl titanate and the like. Typical organozirconates include, for example, neoalkoxy tris-neodecanoyl zirconate, neoalkoxy tris(dioctyl)phosphato zirconate, neoalkoxy tris(dioctyl)pyrphosphata zirconate, neoalkoxy tris(ethylene diamino)ethyl zirconate, neoalkoxy tris(m-amino)phenyl zirconate and the like.

These organosilane, organotitanate and organozirconate bi-functional chemical coupling agents are usually applied to the metal oxide particles prior to dispersion of the particles into the film forming polyester resin. Any suitable technique may be utilized to apply and react the coupling agent with the surface of the metal oxide particles. The deposited coupling agent coating on the particles are continuous, thin, and preferably in the form of a monolayer. A preferred process for applying these bi-functional chemical coupling agents to the metal oxide particles is by stirring the metal oxide particles in an aqueous solution of a hydrolyzed silane. After thoroughly wetting the surface of the metal oxide particles with the aqueous solution to ensure reaction between the reactive groups on the coupling agent molecule and the hydroxyl groups on the outer surface of the metal oxide particles, the treated metal oxide particles may be separated from the aqueous solution by any suitable technique such as filtering. The treated metal oxide particles may thereafter be dried by conventional means such as oven drying, forced air drying, combinations of vacuum and heat drying, and the like. Other techniques of silylation such as contacting the outer surface of the metal oxide particles with vapors or sprays of the bi-functional coupling agent may also be employed. For example, sylylation may be accomplished by pouring or spraying the bi-functional chemical coupling onto the metal oxide particles while the metal oxide particles are agitated in a high intensity mixer at an elevated temperature. In this blending technique, the coupling agent is reacted with the hydroxyl groups directly attached to the metal atoms at the surface of the metal oxide particles to form a reaction product in which the metal oxide particles and the bi-functional coupling agent are chemically bonded to each other through an oxygen atom. Such a process is described, for example, for silica in U.S. Pat. No. 3,915,735, the disclosure of which is incorporated herein by reference in its entirety.

Generally, the concentration of the hi-functional coupling agent in the treating solution should be sufficient to provide at least a continuous mono molecular layer of coupling agent on the surface of the metal oxide particles. Satisfactory results may be obtained with an aqueous solution containing from about I percent by weight to about 5 percent by weight of coupling agent based on the weight of the solution. After drying, the metal oxide particles coated with the reaction product of the bi-functional coupling agent and hydroxyl groups attached to the metal atoms on the outer surface of the metal oxide particles are dispersed in the film forming binder where further reaction occurs between the reactive organo functional groups of the hi-functional coupling agent and reactive groups on the film forming binder molecules to provide mechanical reinforcement. Dispersion may be effected by any suitable conventional mixing technique such as blending the treated metal oxide particles with a molten thermoplastic polyester resin or in a solution of the polyester resin in a solvent. However, dispersion of the treated metal oxide particles in a solution of the polyester is particularly preferred.

Aminosilane bi-functional chemical coupling agents are preferred because the amine functionality not only possess hole blocking capabilities, but also form an excellent chemical bond through interaction with COOH and OH groups of film forming polyesters and excellent chemical bonding is also achieved between the silanol groups of the silane and the hydroxyl groups of the surface of a metal oxide particle through the formation of metal - oxygen - silicon bonds to the metal oxide particles. These silanes are applied in hydrolyzed form because the silanol groups of the silane will readily condense with the hydroxyl groups on the metal oxide particle surfaces and position the organofunctional amine group of the silane outwardly from the metal oxide particle toward the film forming polyester matrix.

The hydrolyzed silane may be prepared by hydrolyzing an aminosilane having the following structural formula:

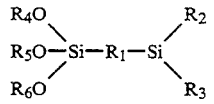

wherein $R_1$ is an alkylidene group containing 1 to 20 carbon atoms, $R_2$ and $R_3$ are independently selected from the group consisting of H, a lower alkyl group containing 1 to 3 carbon atoms, a phenyl group and a poly(ethyleneamino) group, and R4, Rs, and R6 are independently selected from a lower alkyl group containing 1 to 4 carbon atoms. Typical hydrolyzable aminosilanes include 3-aminopropyltriethoxysilane, N-aminoethyl-3aminopropyltrimethoxysilane, N-2-aminoethyl-3-aminopropyltrimethoxysilane, N-2 -aminoethyl-3aminopropyltrimethoxysilane, N-2-aminoethyl-3-aminopropyltris(ethylethoxy)silane, p-aminophenyl trimethoxysilane, 3-aminopropyldiethylmethylsilane, (N,N'-dimethyl 3amino)propyltriethoxysilane, 3-aminopropylmethyldiethoxysilane, 3-aminopropyl trimethoxysilane, N-methylaminopropyltriethoxysilane, methyl[2-(3-trimethoxysilylpropylamino)ethylamino]-3-proprionate, (N,N'-dimethyl 3-ami no) propyl triethoxysilane, N,N-dimethylaminophenyltriethoxy silane, trimethoxysilylpropyldiethylenetriamine and mixtures thereof. The preferred silane materials are 3-aminopropyltriethoxysilane, N-aminoethyl-3-aminopropyltrimethoxysilane, (N,N'-dimethyl 3-amino)propyltriethoxysilane, or mixtures thereof because the hydrolyzed solutions of these materials exhibit a greater degree of basicity and stability and because these materials are readily available commercially. These silanes and others as well as the techniques for hydrolyzing are described, for example, in U.S. Pat. No. 4,464,450, the disclosure thereof being incorporated herein in its entirety. After drying, the reaction product layer formed from the hydrolyzed silane contains larger molecules. The reaction product of the hydrolyzed silane may be linear, partially cross-linked, a dimer, a trimer, and the like.

The hydrolyzed silane solution utilized to treat the metal oxide particles may be prepared by adding sufficient water to hydrolyze the alkoxy groups attached to the silicon atom of the silane to form a solution. Insufficient water will normally cause the hydrolyzed silane to form an undesirable gel. Generally, dilute solutions are preferred for achieving thin coatings. Satisfactory reaction product layers may be achieved with solutions containing from about 0.1 percent by weight to about 10 percent by weight of the silane based on the total weight of solution. A solution containing from about 0.1 percent by weight to about 2.5 percent by weight silane based on the total weight of solution are preferred for stable solutions which form a uniform reaction product layer on the metal oxide particles.

A solution pH between about 4 and about 14 may be employed. Optimum reaction product layers on the metal oxide particles are achieved with hydrolyzed silane solutions having a pH between about 9 and about 13. Control of the pH of the hydrolyzed silane solution may be effected with any suitable organic or inorganic acid or acidic salt. Typical organic and inorganic acids and acidic salts include acetic acid, citric acid, formic acid, hydrogen iodide, phosphoric acid, ammonium chloride, hydrofluorosilicic acid, Bromocresol Green, Bromophenol Blue, p-toluene sulphonic acid and the like.

If desired, the aqueous solution of hydrolyzed silane may also contain additives such as polar solvents other than water to promote the silylation process of involving the metal oxide particles. Any suitable polar solvent other than water may be employed. Typical polar solvents include methanol, ethanol, isopropanol, tetrahydrofuran, methoxyethanol, ethoxyethanol, ethylacetate, ethylformate and mixtures thereof.

Any suitable technique may be utilized to treat the metal oxide particles with the hydrolyzed silane. For example, washed metal oxide particles can be swirled in a hydrolyed silane solution for between about 1 minute and about 60 minutes and then the solids thereafter allowed to settle out and remain in contact with the hydrolyzed silane for between about 1 minute and about 60 minutes. The supernatent liquid may then be decanted and the treated metal oxide particles filtered with filter paper. The metal oxide particles may be dried at between about 1 minute and about 60 minutes at between about 80° C. and about 165° C. in a forced air oven for between about I minute, and about 60 minutes if desired, hydrolysis of the silane may be effected at the surface of the metal oxide particles such as silica as described, for example, in Example 2 of U.S. Pat. No. 3,915,735, the disclosure thereof being incorporated herein in its entirety.

Silica particles treated with bi-functional silane coupling agents are also commercially available. For example, silica particles reacted with an amino silane are available as Aerosil S502, Aerosil S506 and Aerosil R504, from Degussa AG. Aerosils 130, 150, 200 and 300 also available from Degussa AG or Cab-0-Sils H5, EH5, HS5, MS, M7, MS5, MS7, and M7D may be surface treated by following the silane/silica treatment procedure described above and used in the hole blocking adhesive layer of this invention. Both Aerosil and Cab-O -Sil products are synthetic amorphous silica and are spherical in shape.

Any suitable polyester resin may be utilized as the binder matrix for the treated metal oxide particles. Typical polyester resins include film-forming polymers such as du Pont 49,000 resin (available from E.I. du Pont de Nemours & Co.), Vitel-PE100 (available from Goodyear Rubber & Tire Co). These polyesters and others are described in U.S. Pat. No. 4,786,570, the disclosure thereof being incorporated herein in its entirety. Unlike the single hole blocking adhesive layer of this invention, the polyester resins described in U.S. Pat. No. 4,786,570 are used in an adhesive layer used in conjunction with a separate silane hole blocking layer. The hole blocking adhesive layer of this invention should contain at least about 1 percent by weight polyester based on the total weight of the binder matrix material. Any suitable non-polyester film forming polymer may be employed in a blend with the essential polyester component. The non-polyester film forming polymer must be miscible with the polyester at the proportion selected. Typical non-polyester film forming polymers that can be miscible with polyesters, depending upon the specific polyester and proportional ratio selected, include polycarbonates, polyvinyl chlorides, polyvinylbutyrals, polyvinylpyrrolidones, polyurethanes, polymethyl methacrylates, and the like. Since the degree of miscibility varies with the specific non-polyester film forming polymer and specific polyester selected, some experimentation with the materials selected is desirable to determine whether the selected proportions are miscible.

Any suitable conventional coating technique may be utilized to apply the hole blocking adhesive layer of this invention to the supporting substrate or to the charge generating layer. Typical coating techniques include solvent coating, extrusion coating, spray coating, lamination, dip coating, solution spin coating and the like. The wet deposited coating may be dried by any conventional drying technique such as oven drying, forced air drying, circulating air oven drying, radiant heat drying, and the like to give a satisfactory dry thickness of between about 0.05 micrometer and about 3 micrometers. A thickness range between about 0.07 micrometers and about 2 micrometers is preferred. Optimum results are achieved with a thickness between about 0.1 micrometer and about 1.5 micrometers.

When the hole blocking adhesive layer of this invention is positioned between the substrate and the charge generating layer, it surprisingly performs the dual functions of a blocking layer that prevents migration of positive charges from the underlying conductive surface of the substrate and an adhesive layer thereby eliminating the need for separately applied blocking and adhesive layers. This greatly simplifies the device structure, reduces fabrication steps, increases product yield and reduces costs.

If desired, an optional interface layer comprising any suitable film forming polymer may be utilized between the hole blocking adhesive layer of this invention and the charge generating layer in embodiments where the charge generating layer is located between the substrate and the charge transport layer. This optional interface layer should be compatible with and not degrade the physical or electrical properties of the hole blocking adhesive layer or the charge generating layer. Typical film forming polymers for this optional interface layer include polyesters, polycarbonates, polyvinyl chlorides, polyvinylbutyrals, polyvinylpyrrolidones, polyurethanes, polymethyl methacrylates, and the like. The optional interface layer may also contain silica particles treated with a coupling agent. A loading up to about 90 weight percent treated silica may be used. Generally this optional interface layer should have a uniform thickness up to about 1 micrometer.

Any suitable charge generating (photogenerating) layer may be applied to the hole blocking adhesive layer of this invention. Charge generating layers are well know in the art and can comprise homogeneous layers or photoconductive particles dispersed in a film forming binder. Examples of charge generating layers are described, for example, in U.S. Pat. No. 3,357,989, U.S. Pat. No. 3,442,781, and U.S. Pat. No. 4,415,639, the disclosures thereof being incorporated herein in their entirety. Other suitable Photogenerating materials known in the art may also be utilized, if desired.

Any suitable polymeric film forming binder material may be employed as the matrix in of the photogenerating layer. Typical polymeric film forming materials include those described, for example, in U.S. Pat. No. 3,121,006, the disclosure thereof being incorporated herein in its entirety. When the charge generating layer is applied to the hole blocking adhesive layer of this invention, the binder polymer should adhere well to the adhesive layer, dissolve in a solvent which also partially dissolves the upper surface of the adhesive layer and is miscible with the polyester of the adhesive layer to form a polymer blend zone. Typical solvents include tetrahydrofuran, cyclohexanone, methylene chloride, 1,1,1trichloroethane, 1,1,2-trichloroethane, trichloroethylene, toluene, and the like, and mixtures thereof. Mixtures of solvents may be utilized to control evaporation range. For example, satisfactory results may be achieved with a tetrahydrofuran to toluene ratio of between about 90:10 and about 10:90 by weight. Generally, the combination of photogenerating pigment, binder polymer and solvent should form uniform dispersions of the photogenerating pigment in the charge generating layer coating composition. Typical combinations include polyvinylcarbazole, trigonal selenium and tetrahydrofuran; phenoxy resin, trigonal selenium and toluene; and polycarbonate resin, vanadyl phthalocyanine and methylene chloride, The solvent for the charge generating layer should dissolve the polymer binder utilized in the charge generating layer and be capable of dispersing the photogenerating pigment particles present in the charge generating layer.

The photogenerating composition or pigment may be present in the resinous binder composition in various amounts. Generally, from about 5 percent by volume to about 90 percent by volume of the photogenerating pigment is dispersed in about 10 percent by volume to about 90 percent by volume of the resinous binder. Preferably from about 20 percent by volume to about 30 percent by volume of the photogenerating pigment is dispersed in about 70 percent by volume to about 80 percent by volume of the resinous binder composition. In one embodiment about 8 percent by volume ofthe photogenerating pigment is dispersed in about 92 percent by volume of the resinous binder composition.

The photogenerating layer generally ranges in thickness from about 0.1 micrometer to about 5.0 micrometers, preferably from about 0,3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

Any suitable and conventional technique may be utilized to mix and thereafter apply the photogenerating layer coating mixture to the previously dried adhesive layer. Drying of the deposited coating may be effected by any suitable conventional technique.

The charge transport layer may comprise any suitable transparent organic polymer or non-polymeric material capable of supporting the injection of photogenerated holes or electrons from the charge generating layer and allotring the transport of these holes or electrons through the organic layer to selectively discharge the surface charge. The charge transport layer not only serves to transport holes or electrons, but also protects the photoconductive layer from abrasion or chemical attack. The charge transport layer should exhibit negligible, if any, discharge when exposed to a wavelength of light useful in xerography, e,g. 4000 Angsttoms to 9000 Angsttoms. The charge transport layer is normally transparent in a wavelength region in which the electrophotographic imaging member is to be used when exposure is effected therethrough to ensure that most of the incident radiation is utilized by the underlying charge generating layer. When used with a transparent substrate, imagewise exposure or erase may be accomplished through the substrate with all light passing through the substrate, In this case, the charge transport material need not transmit light in the wavelength region of use if the charge generating layer is sandwiched between the substrate and the charge transport layer. The charge transport layer in conjunction with the charge generating layer is an insulator to the extent that an electrostatic charge placed on the charge transport layer is not conducted in the absence of illumination. Charge transport layer materials are well known in the art.

The charge transport layer may comprise activating compounds or charge transport molecules dispersed in normally, electrically inactive film forming polymeric materials for making these materials electrically active. These charge transport molecules may be added to polymeric materials which are incapable of supporting the injection of photogenerated holes and incapable of allowing the transport of these holes. An especially preferred transport layer employed in multi-layer photoconductors comprises from about 25 percent to about 75 percent by weight of at least one charge transporting aromatic amine, and about 75 percent to about 25 percent by weight of a polymeric film forming resin in which the aromatic amine is soluble. Examples of typical charge transporting aromatic amines include triphenylmethane, bis(4-diethylamine-2-methylphenyl)-phenylmethane; 4'-4''-bis(diethylamino)-2', 2''-dimethyltriphenylmethane; N,N'-bis(alkylphenyl)-(1,1'-biphenyl)-4,4'-diamine wherein the alkyl is, for example, methyl, ethyl, propyl, n-butyl, etc.; N,N'-diphenyl-N,N'-bis(3''-methylphenyl)-(1,1'biphenyl)-4,4'diamine; and the like, dispersed in an inactive resin binder.

Any suitable inactive resin binder soluble in methylene chloride or other suitable solvents may be employed. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000. Other solvents that may dissolve these binders include tetrahydrofuran, toluene, trichloroethylene, 1,1,2-trichloroethane, 1,1,1-trichloroethane, and the like.

The thickness of the charge transport layer may range from about 10 micrometers to about 50 micrometers, and preferably from about 20 micrometers to about 35 micrometers. Optimum thicknesses may range from about 23 micrometers to about 31 micrometers.

An optional conventional ground strip may be utilized along one edge of the electrophotgraphic imaging member. The ground strip may comprise a film forming polymer binder and electrically conductive particles. The ground strip may comprise materials those include those enumerated in U.S. Pat. No. 4,664,995. The ground strip layer may have a thickness from about 7 micrometers to about 42 micrometers, and preferably from about 14 micrometers to about 23 micrometers.

An optional conventional anti-curl layer may also be employed. The anti-curl layer may comprise organic polymers or inorganic polymers that are electrically insulating or slightly semi-conductive. The anti-curl layer provides flatness and/or abrasion resistance. The anti-curl layer is formed at the back side of the substrate, opposite to the imaging layers. The thickness of the anti-curl layer is from about 3 micrometers to about 35 micrometers, and preferably about 14 micrometers.

An optional conventional overcoating layer may also be used. The optional overcoating layer may comprise organic polymers or inorganic polymers that are electrically insulating or slightly semi-conductive. The overcoating layer may range in thickness from about 2 micrometers to about 8 micrometers, and preferably from about 3 micrometers to about 6 micrometers. An optimum range of thickness is from about 3 micrometers to about 5 micrometers.

BRIEF DESCRIPTION OF THE DRAWINGS

A more complete understanding of the present invention can be obtained by reference to the accompanying Figures.

These figures merely schematically illustrate the prior art and the present invention and are not intended to indicate relative size and dimensions of actual electrophotographic imaging members or components thereof.

DESCRIPTION OF PREFERRED EMBODIMENTS

Figure 1:
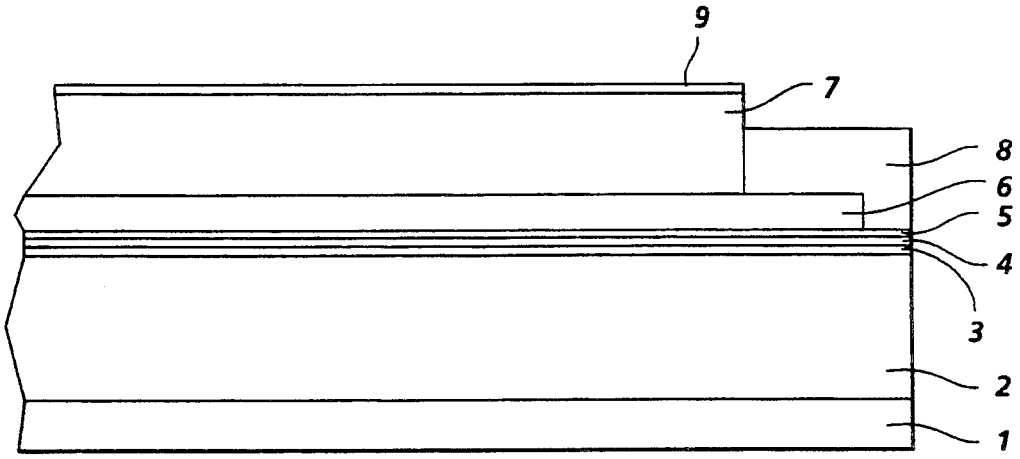
FIG. 1 PRIOR ART
FIG. 1 shows a cross-sectional view of a typical prior art multilayered electrophotographic member.

A representative structure of a prior art electrophotographic imaging member is shown in FIG. 1. This imaging member is provided with an anti-curl back coating 1, a supporting substrate 2, an electrically conductive ground plane 3, a blocking layer 4, an adhesive layer 5, a charge generating layer 6, a charge transport layer 7, and a ground strip 8 adjacent charge transport layer 7 at an outer edge of the imaging member. An optional overcoating layer 9 is also shown in FIG. 1.

Figure 2:
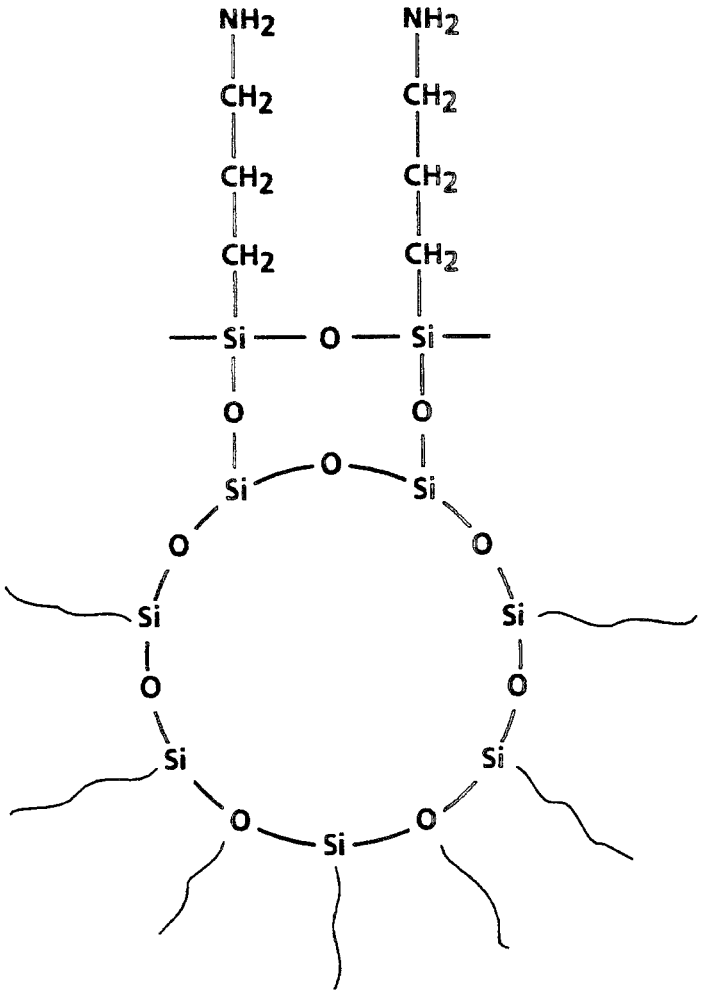
FIG. 2 is a schematic illustration of an amino silane surface treated silica particle.

Illustrated in FIG. 2 is a schematic depiction of the reaction product of a silica particle and a hydrolyzed nitrogen containing organo silane reactant. The reaction product shown comprises a monomolecular silane reaction product layer in which the silicon atoms at the outer surface of the silica particle is chemically bonded to the silicon atom of each silane through an oxygen atom and each silicon atom of each silane is also bonded to the silicon atom of an adjacent silane through another oxygen atom. The wavy lines represent additional silane moieties. The alignment of the silane moieties position the amino groups away from the surface of the silica particles.

Figure 3A:
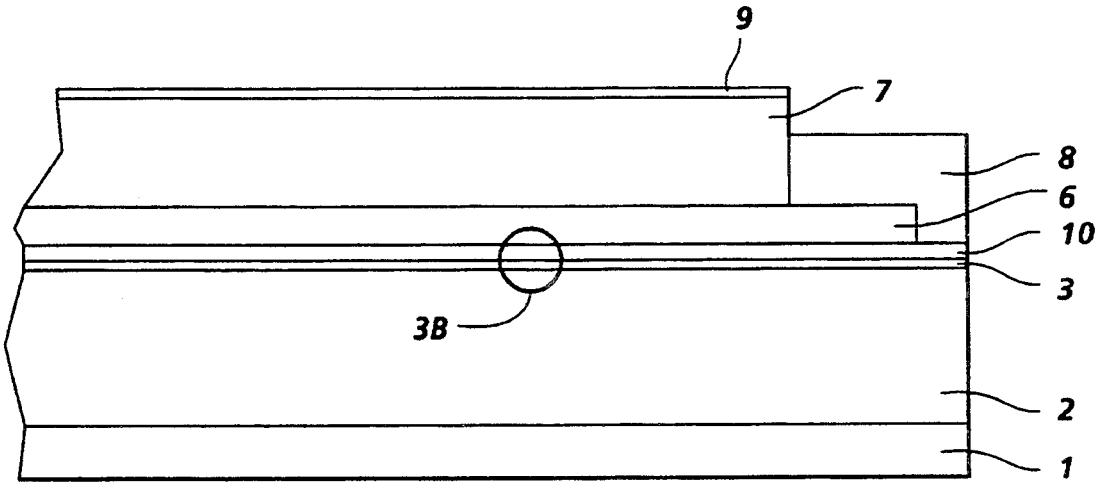
FIG. 3A shows a cross-sectional view of one embodiment of a multilayered electrophotographic member of this invention.

The structure of a typical electrophotographic imaging member of one embodiment of this invent, on is shown in FIG. 3A. This imaging member is provided with an anti-curl back coating 1, a supporting substrate 2, an electrically conductive ground plane 3, a charge generating layer 6, a charge transport layer 7, a ground strip 8 and an optional overcoating layer 9, all of which are conventional. However, the imaging member shown in FIG. 3A is also provided with the hole blocking adhesive layer 10 of this invention.

Figure 3B:
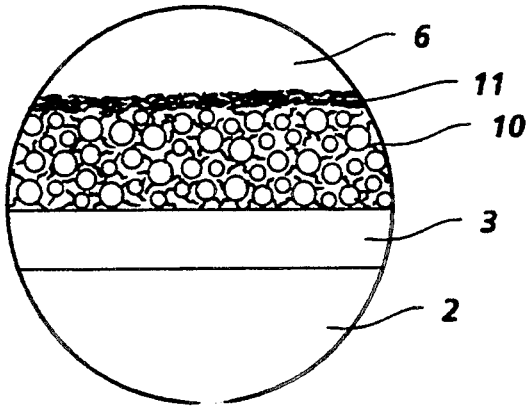
FIG. 3B shows an expanded cross-sectional view of a portion of the multilayered electrophotographic member shown in FIG. 3A.

In FIG. 3 B, an expanded cross-sectional view of a portion of the multilayered electrophotographic member shown in FIG. 3A is shown. Hole blocking adhesive layer 10 is magnified to illustrate the uniformly dispersed treated silica particles and a blend zone 11 comprising a blend of some polyester binder material from the upper surface of hole blocking adhesive layer 10 and some polymer binder material from charge generating layer 6.

The hole blocking adhesive layer of this invention greatly simplifies the structural of prior art multi-layered electrophotographic imaging members by replacing separate hole blocking layer and adhesive layer combinations. In the embodiments of the present invention the coating of a silane hole blocking layer followed by application of an adhesive layer was eliminated by a single layer which simultaneously provides adhesion linkage and as hole blocking functions. The present invention produced numerous benefits including elimination of all the disadvantages associated with the silane blocking layer, simplification of the electrophotographic imaging member structure, and increased production throughput and yield. The stronger adhesion bond strength provided by the single hole blocking adhesive layer of this invention reduces seam cracking and layer delamination in welded multi-layered electrophotographic imaging members. The hole blocking adhesive layer of this invention can provide both hole blocking and adhesive functions for a seamless imaging member employing a conductive seamless polymeric support substrate. Further, the hole blocking adhesive layer of this invention enhances the wear resistance of imaging members used in negative charging electrophotographic imaging processes. Moreover, substitution of the hole blocking adhesive layer of this invention for both the hole blocking layer and adhesive layer of prior art multi-layered electrophotographic imaging devices did not adversely affect the photoelectrical integrity of the original imaging devices.

The invention will now be described in detail with respect to specific preferred embodiments thereof, it being noted that these examples are intended to be illustrative only and are not intended to limit the scope of the present invention Parts and percentages are by weight unless otherwise indicated.

EXAMPLE 1

A flexible electrophotographic imaging member was prepared by providing a titanium coated polyester substrate (Melinex 442, available from ICI Americas, Inc.) having a thickness of 3 mils (76.2 micrometers) and applying thereto, using a ½ rail gap Bird applicator, a solution containing 10 gins 3-aminopropyltriethoxysilane, 10.1 gins distilled water, 3 gins acetic acid, 684.8 gins of 200 proof denatured alcohol and 200 gins heptane. This layer was then allowed to dry for 5 minutes at 135° C in a forced air oven. The resulting blocking layer had an average dry thickness of 0.05 micrometer measured with an ellipsometer. However, the ellipsometry profile showed an extremely non-uniform silane thickness due to surface irregularities and the formation of islands of siloxane aggregates.

An adhesive interface layer was then prepared by applying with a ½ rail gap Bird applicator to the blocking layer a wet coating containing 1.1 percent by weight based on the total weight of the solution of polyester adhesive (DuPont 49,000, available for E. I. du Pont de Nemours & Co.) in a 70:30 volume ratio mixture of tetrahydrofuran/cyclohexanone. The adhesive interface layer was allowed to dry for 5 minutes at 135° C. in the forced air oven. The resulting adhesive interface layer had a dry thickness of 0.12 micrometer.

The adhesive interface layer was thereafter coated with a photogenerating layer containing 7.5 percent by volume trigonal Se, 25 percent by volume N,N'-diphenyl-N,N'-bis(3-methylphenyl)-1,1'-biphenyl-4,4'-diamine, and 67.5 percent by volume polyvinylcarbazole. This photogenerating layer was prepared by introducing 8 gms polyvinyl carbazole and 140 mls of a 1: 1 volume ratio of a mixture of tetrahydrofuran and toluene into a 20 oz. amber bottle. To this solution was added 8 gms of trigonal selenium and 1,000 gms of ⅛ inch (3.2 millimeter) diameter stainless steel shot. This mixture was then placed on a ball mill for 72 to 96 hours. Subsequently, 50 gins of the resulting slurry were added to a solution of 3.6 gms of polyvinyl carbazole and 2.0 gms of N,N'-diphenyl-N,N'-bis(3-methylphenyl)-1,1'-biphenyl-4,4'-diamine dissolved in 75 ml of 1:1 volume ratio of tetrahydrofuran/toluene. This slurry was then placed on a shaker for 10 minutes. The resulting slurry was thereafter applied to the adhesive interface layer by using a ½ rail gap Bird applicator to form a coating layer having a wet thickness of 0.5 rail (12.7 micrometers). However, a strip about 3 mm wide along one edge of the substrate bearing the blocking layer and the adhesive layer was deliberately left uncoated by any of the photogenerating layer material to facilitate adequate electrical contact by the ground strip layer that was applied later. This photogenerating layer was dried at 135° C. for 5 minutes in the forced air oven to form a dry thickness photogenerating layer having a thickness of 2.0 micrometers.

This coated imaging member web was simultaneously overcoated with a charge transport layer and a ground strip layer using a 3 mil gap Bird applicator. The charge transport layer was prepared by introducing into an amber glass bottle a weight ratio of 1 : 1 N,N'-diphenyl-N,N'-bis(3-methylphenyl)-1,1'-biphenyl-4,4'-diamine and Makrolon 5705, a polycarbonate resin having a molecular weight of from about 50,000 to 100,000 commercially available from Farbensabricken Bayer A.G. The resulting mixture was dissolved to give a 15 percent by weight solid in 85 percent by weight methylene chloride. This solution was applied onto the photogenerator layer to form a coating which upon drying had a thickness of 24 micrometers.

The approximately 3 mm wide strip of about of the adhesive layer left uncoated by the photogenerator layer was coated with a ground strip layer during the co-coating process. This ground strip layer had a dried thickness of about 14 micrometers. This ground strip is electrically grounded, by conventional means such as a carbon brush contact means during conventional xerographic imaging.

The resulting imaging member web containing all of the above layers was annealed at 135° C. in the forced air oven for 5 minutes.

An anti-curl coating was prepared by combining 8.82 gms of polycarbonate resin (MakroIon 5705, available from Bayer AG), 0.09 gm of polyester resin (Vitel PE-100, available from Goodyear Tire and Rubber Company) and 90.1 gins of methylene chloride in a glass container to form a coating solution containing 8.9 percent solids. The container was covered tightly and placed on a roll mill for about 24 hours until the polycarbonate and polyester were dissolved in the methylene chloride to form the anti-curl coating solution. The anti-curl coating solution wasthen applied to the rear surface (side opposite the photogenerator layer and charge transport layer) of the imaging member with a 3 mil gap Bird applicator and dried at 135° C. for about 5 minutes in the forced air oven to produce a dried film thickness of about 13.5 micrometers. The resulting electrophotographic imaging member had a structure similarto that schematically shown in FIG. 1 and was used as an imaging member control.

EXAMPLE II

A flexible electrophotographic imaging member was prepared by following the procedures and using the same materials as described in Example I, except that the application of the silane blocking layer was intentionally omitted.

EXAMPLE III

A flexible electrophotographic imaging member was prepared by following the procedures and using the same materials as described in Example II, except that the 49,000 polyester adhesive interface layer was mixed with 60 percent by weight 3-aminopropyl triethoxy silane treated fumed silica (Aerosil S506, available from Degussa A.G). In contrast to the non-uniformity observed in the silane blocking layer described in Example I, the hole blocking adhesive layer of this invention was uniform in thickness and had an even surface profile. The configuration of this imaging member is similar to the imaging member schematically illustrated in FIG. 3. The silica was a synthetic amorphous silica having a density of about 2.3 gms/cc. With an average particle diameter of about 150 Angstroms and about 200 square meters of surface area per gram weight, the silica (schematically illustrated in FIG. 2) provides a large surface area for abundant silane coverage.

EXAMPLE IV

A flexible electrophotographic imaging member was prepared in the same manner according to Example III, except that the 49,000 polyester adhesive was replaced with another polyester (Vitel PE-100, available from Goodyear Tire & Rubber Company). The resulting hole blocking-adhesive interface layer was very uniform in thickness.

EXAMPLE V

A flexible electrophotographic imaging member was prepared in the same manner according to Example III, except that the 49,000 polyester adhesive was replaced with polyvinyl chloride (Geon, available from B.F. Goodrich). The resulting hole blocking-adhesive interface layer had a uniform thickness.

EXAMPLE VI

A flexible electrophotographic imaging member was prepared in the same manner according to Example III, except that the 49,000 polyester adhesive was replaced with a polymer blend consisting of 99 parts by weight MakroIon 5705 and one part by weight of Vitel PE-100. To facilitate MakroIon dissolution, methylene chloride was used as the solvent for adhesive layer coating solution preparation. The resulting hole blocking adhesive interface layer was uniform in thickness.

EXAMPLE VII

The fabricated electrophotographic imaging members of Examples I through VI were assessed for their hydrolytic stability by submerging cut 1×3" test samples in a 25° C. distilled water bath overnight. Spontaneous imaging member layer delamination was noted for the test sample of Example I. Since this imaging member had a separate silane blocking layer coated over the titanium ground plane, the observed layer delamination might have been due to water attack of the silane layer thereby causing the development of hydrolytic degradation of the silicon-oxygen-metal bonds, similar to that reported by P.A.M. Steernan and F.H.J. Maurer, A Dielectric Study of Interfacial Water in Silane Modified HDPE Glass Composites, Abstracts, The Fourth international Conference of Composite Interfaces, pages 20–21, May 26–29, 1992, Cleveland, Ohio.

No imaging member layer delamination was observed for all the rest of the test samples of Examples II through VI in which the application of a silane blocking layer was intentionally omitted. These test results demonstrate that the imaging member of this invention will exhibit robust mechanical performance when cycled in an electrophotographic imaging machine under humid service environments.

EXAMPLE VIII

The electrophotographic imaging members prepared according to Examples I through VI were cut into 3"×4" samples and evaluated for their photoelectrical integrity using a xerographic testing scanner comprising a cylindrical aluminum drum having a diameter of 24.26 cm (9.55 inches). The test samples were taped onto the drum. When rotated, the drum carrying the samples produced a constant surface speed of 76.3 cm (30 inches) per second. A direct current pin corotron, exposure light, erase light, and five electrometer probes were mounted around the periphery of the mounted imaging samples. The sample charging time was 33 milliseconds. Both expose and erase lights had broad band white light (400–700 nm) outputs, each comprising a 300 watt output Xenon arc lamp. The relative locations of the probes and lights are indicated in Table I below:

TABLE I

| Element | Angle (Degrees) | Position | Distance From Photoreceptor |
|---|---|---|---|
| Charge | 0 | 0 | 18 mm (Pins)<br>12 mm (Shield) |
| Probe 1 | 22.50 | 47.9 mm | 3.17 mm |
| Expose | 56.25 | 118.8 | N.A. |
| Probe 2 | 78.75 | 166.8 | 3.17 mm |
| Probe 3 | 168.75 | 356.0 | 3.17 mm |
| Probe 4 | 236.25 | 489.0 | 3.17 mm |
| Erase | 258.75 | 548.0 | 125 mm |
| Probe 5 | 303.75 | 642.9 | 3.17 mm |

The test samples were first rested in the dark for at least 60 minutes to ensure achievement of equilibrium with the testing conditions at 5 percent relative humidity and 21° C. Each sample was then negatively charged in the dark to a development potential of about 900 volts. The charge acceptance of each sample and its residual potential after discharge by front erase exposure to 400 ergs/cm2 were recorded. The test procedure was repeated to determine the photo induced discharge characteristic (PIDC) of each sample by different light energies of up to 20 ergs/cm$^2$. The 50,000 cycle electrical testing results obtained for the test samples of Examples I, II, IV and VI are collectively tabulated in the following Table II.

TABLE II

| Example | Silane Layer | Adhesive and/or Blocking Layer | Dark Decay Rate (V/sec) | Residual Potential (V) | 50K Cycles Cycle-Down (%) |
|---|---|---|---|---|---|
| I (Control) | Yes | 49,000 | 155 | 9 | 17 |
| II | No | 49,000 | 324 | 5 | 68 |
| III | No | 49K + Silica | 154 | 9 | 16 |
| IV | No | PE100 + Silica | 156 | 9 | |
| V | No | PVC + Silica | 152 | 7 | 16 |
| VI | No | Mak./ PE100 + Silica | 157 | 8 | 18 |

The 50,000 cycles electrical data show that addition of about 60 weight percent of silane treated silica into the adhesive interface layer for the invention imaging samples of Examples III, IV. V and VI gave essentially equivalent dark decay rates, residual voltages, PIDCs and 50,000 cycles cycle-down results when compared to the control imaging sample of Example I. In sharp contrast, the imaging member of Example II, having no silane blocking layer and without silica incorporation in the adhesive interface layer, exhibited high dark decay and developed excessive electrically cycle-down after 50,000 cycles of testing.

The electrical cyclic test results obtained for the test samples of the imaging members of this invention in Examples III, IV, V and VI are of particular importance because they indicate that incorporation of silane treated silica in the adhesive layer can not only provide the desired hole blocking properties without the need of a separate blocking layer, it also maintains the crucial electrical integrity of each electrophotographic imaging member as well.

EXAMPLE IX

A 5 weight percent coating solution consisting of 99 parts by weight Makroion 5705/2 parts by weight Vitel PE-100 in methylene chloride were prepared. A second coating solution of same composition was also prepared except having a 10 weight percent (with respect to the polymer blend) dispersion of the silane treated silica addition in the solution. Both solutions were coated onto titanium/Melinex 442 support substrate, using a 3 mil gap Bird applicator. The wet coated films were then dried for 5 minutes at 135° C. in the forced air oven to yield about 12 micrometers and about 16 micrometers in dry thickness coatings, respectively. These coating samples were cut to a size of 2.54 cm by 30.5 cm (1 inch by 12 inches) and tested for resistance to wear. Testing was effected by means of a dynamic mechanical cycling device in which glass tubes were skidded across the surface of the coating layer on each sample. More specifically, one end of the test sample was clamped to a stationary post and the sample was looped upwardly over three equally spaced horizontal glass tubes and then downwardly through a generally inverted "U" shaped path with the free end of the sample secured to a weight which provided one pound per inch width tension on the sample. The face of the sample bearing the coating layer was facing downwardly such that it was allowed to contact the glass tubes. The glass tubes each had a diameter of 2.54 cm (one inch). Each tube was securely fixed at each end to an adjacent vertical surface of a pair of disks that were rotatable about a shaft connecting the centers of the disks. The glass tubes were parallel to and equidistant from each other and equidistant from the shaft connecting the centers of the disks. Although the disks were rotated about the shaft, each glass tube was rigidly secured to the disk to prevent rotation of the tubes around each individual tube axis. Thus, as the disk rotated about the shaft, two glass tubes were maintained at all times in sliding contact with the surface of the coating layer. The axis of each glass tube was positioned about 4 cm from the shaft. The direction of movement of the glass tubes along the coating layer surface was away from the weighted end of the sample toward the end clamped to the stationary post. Since there were three glass tubes in the test device, each complete rotation of the disks was equivalent to three wear cycles in which the surface of the coating layer was in sliding contact with a single stationary support tube during testing. The rotation of the spinning disks was adjusted to provide the equivalent of 28.7 cm (11.3 inches) per second tangential speed. The extent of the coating layer wear was measured using a permascope and expressed as the amount of thickness change at the end of 330,000 wear cycles of testing.

The results obtained for wear resistance tests are listed in Table III below and show that the coating layer containing 10 weight percent silica has significantly higher wear resistance compared to the control counterpart. This wear improvement result indicates that when the invention hole blocking-adhesive layer is used as an outer surface layer in a positive charging imaging device, no protective overcoating is required to extend its service life.

TABLE III

| Coating Composition | Amount of Thickness Reduction After 330,000 Wear Cycles (Micrometers) |
|---|---|
| Makrolon/PE100 (Control) | 12.3 |
| Makrolon/PE100 + Silica | 0.5 |

Although the invention has been described with reference to specific preferred embodiments, it is not intended to be limited thereto, rather those skilled in the art will recognize that variations and modifications may be made therein which are within the spirit of the invention and within the scope of the claims.

What is claimed:

1. An electrophotographic imaging member comprising a substrate, a hole blocking adhesive layer, a charge generating layer and a charge transport layer, said hole blocking adhesive layer comprising a polyester film forming binder matrix having dispersed therein a particulate reaction product of oxide particle reactant and a hydrolyzed reactant, said oxide reactant being selected from the group consisting of metal oxide particles and silicon oxide particles having an average particle size of between about 50 Angstroms and about 300 Angstroms, and said hydrolyzed reactant being selected from the group consisting of a nitrogen containing organo silane, an organotitanate and an organozirconate and mixtures thereof.

2. An electrophotographic imaging member according to claim 1 wherein said charge transport layer is sandwiched between said substrate and said charge generating layer.

3. An electrophotographic imaging member according to claim 2 wherein said charge generating layer has one surface in contiguous contact with said charge transport layer and the opposite surface in contiguous contact with said hole blocking adhesive layer.

4. An electrophotographic imaging member according to claim 1 wherein said electrophotographic imaging member is free of any distinct adhesive layer in contiguous contact with said hole blocking adhesive layer.

5. An electrophotographic imaging member according to claim 1 wherein said oxide particles are amorphous silica particles having a spherical shape.

6. An electrophotographic imaging member according to claim 1 wherein said hole blocking adhesive layer has a dry thickness between about 0.05 micrometer and about 3 micrometers.

7. An electrophotographic imaging member according to claim 1 wherein said hole blocking adhesive layer comprises between about 10 percent by weight and about 95 percent by weight of said particulate reaction product, based on the total weight of said hole blocking adhesive layer.

8. An electrophotographic imaging member comprising a substrate, a hole blocking adhesive layer, a charge generating layer and a charge transport layer, said hole blocking adhesive layer comprising a polyester film forming binder matrix having dispersed therein a particulate reaction product of oxide particle reactant and a hydrolyzed reactant, said oxide reactant being selected from the group consisting of metal oxide particles and silicon oxide particles having an average particle size of between about 50 Angstroms and about 300 Angstroms, said hydrolyzed reactant being selected from the group consisting of a nitrogen containing organo silane, an organotitanate and an organozirconate and mixtures thereof and said charge generating layer being sandwiched between said hole blocking adhesive layer and said charge transport layer.

9. An electrophotographic imaging process comprising providing an electrophotographic imaging member comprising a substrate, a hole blocking adhesive layer, a charge generating layer and a charge transport layer, said hole blocking adhesive layer comprising a polyester film forming binder matrix having dispersed therein a particulate reaction product of oxide particle reactant and a hydrolyzed reactant, said oxide reactant being selected from the group consisting of metal oxide particles and silicon oxide particles having an average particle size of between about 50 Angstroms and about 300 Angstroms, and said hydrolyzed reactant being selected from the group consisting of a nitrogen containing organo silane, an organotitanate and an organozirconate and mixtures thereof, said electrophotographic imaging member being free from distinct adhesive layers in contiguous contact with said hole blocking adhesive layer, forming an electrostatic latent image on said electrophotographic imaging member, developing said electrostatic latent image with marking particles to form a marking image corresponding to said electrostatic latent image and transfering said marking image to a receiving member.

10. An electrophotographic imaging process according to claim 9 wherein said charge generating layer is sandwiched between said hole blocking adhesive layer and said charge transport layer.

11. An electrophotographic imaging process according to claim 9 wherein said charge transport layer is sandwiched between said substrate and said charge generating layer.

12. An electrophotographic imaging process according to claim 11 wherein said charge generating layer has one surface in contiguous contact with said charge transport layer and the opposite surface in contiguous contact with said hole blocking adhesive layer.

13. An electrophotographic imaging process according to claim 9 wherein said electrophotographic imaging member is free of any distinct adhesive layer in contiguous contact with said hole blocking adhesive layer.

14. An electrophotographic imaging process according to claim 9 wherein said metal particles are silica particles.

15. An electrophotographic imaging process according to claim 9 wherein said hole blocking adhesive layer has a dry thickness between about 0.05 micrometer and about 3 micrometers.

16. An electrophotographic imaging process according to claim 9 wherein said hole blocking adhesive layer comprises between about 10 percent by weight and about 95 percent by weight of said particulate reaction product, based on the total weight of said hole blocking adhesive layer.

* * * * *